US009782989B2

(12) United States Patent
Nishiyama

(10) Patent No.: US 9,782,989 B2
(45) Date of Patent: Oct. 10, 2017

(54) INKJET PRINTER FOR CONTINUOUS PAPER

(71) Applicant: RISO KAGAKU CORPORATION, Tokyo (JP)

(72) Inventor: Akira Nishiyama, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/196,606

(22) Filed: Jun. 29, 2016

(65) Prior Publication Data

US 2017/0028755 A1 Feb. 2, 2017

(30) Foreign Application Priority Data

Jul. 29, 2015 (JP) ..... 2015-149723

(51) Int. Cl.

| | |
|---|---|
| ***B41J 25/308*** | (2006.01) |
| ***B41J 15/16*** | (2006.01) |
| ***B41J 11/42*** | (2006.01) |
| ***B41J 2/01*** | (2006.01) |

(52) U.S. Cl.

CPC ..... *B41J 25/308* (2013.01); *B41J 2/01* (2013.01); *B41J 11/42* (2013.01); *B41J 15/16* (2013.01); *B41J 25/3086* (2013.01)

(58) Field of Classification Search

CPC ..... B41J 15/16

See application file for complete search history.

(56) References Cited

U.S. PATENT DOCUMENTS

2011/0279510 A1 11/2011 Takeuchi et al.
2011/0316909 A1* 12/2011 Yamanobe ..... B41J 11/0015 347/8
2013/0100194 A1* 4/2013 Biglari ..... B41J 15/16 347/16
2013/0112798 A1* 5/2013 Imamura ..... B41J 15/165 242/419.8
2013/0135370 A1* 5/2013 Oba ..... B41J 15/16 347/9

FOREIGN PATENT DOCUMENTS

| | | |
|---|---|---|
| EP | 2 384 894 | 11/2011 |
| JP | 2011-189748 | 9/2011 |
| WO | 2014/114351 | 7/2014 |

OTHER PUBLICATIONS

Extended European Search Report for EP 16180107.1 having a mailing date of Mar. 16, 2017.

* cited by examiner

*Primary Examiner* — Shelby Fidler
(74) *Attorney, Agent, or Firm* — Greenblum & Bernstein, P.L.C.

(57) ABSTRACT

A controller drives a conveyer to start to convey a sheet of continuous paper and accelerates the sheet to a printing conveyance speed, and drives an inkjet head to start to perform a printing while driving the conveyer to convey the sheet at the printing conveyance speed. The controller drives a tension adjuster to adjust a tension of the sheet such that the tension of the sheet during acceleration after start of conveyance of the sheet is smaller than the tension of the sheet during the printing, and drives the head gap adjuster to adjust a head gap between the inkjet head and the sheet such that a first head gap during the acceleration of the sheet is greater than a second head gap during the printing.

6 Claims, 8 Drawing Sheets

INKJET PRINTER FOR CONTINUOUS PAPER

CROSS REFERENCE TO RELATED APPLICATION

This application is based upon and claims the benefit of priority from the prior Japanese Patent Application No. 2015-149723, filed on Jul. 29, 2015, the entire contents of which are incorporated herein by reference.

BACKGROUND

1. Technical Field

The disclosure relates to an inkjet printer configured to perform printing by ejecting ink from an inkjet head onto continuous paper.

2. Related Art

Japanese Patent Application Publication No. 2011-189748 proposes an inkjet printer which performs printing by unwinding a sheet of long continuous paper from a sheet roll and ejecting inks from an inkjet head onto the sheet while conveying the sheet.

In the inkjet printer described above, the behavior of the sheet is unstable during acceleration after start of sheet conveyance, and the sheet under the inkjet head sometimes moves up and down. Accordingly, if the printing is performed by ejecting the inks from the inkjet head during the acceleration of the sheet, landing positions of the inks deviate from their proper positions and print quality decreases in some cases.

In view of this, some inkjet printer is configured to suspend printing during the acceleration of the sheet and, after the sheet reaches a predetermined printing conveyance speed, perform the printing by ejecting the inks from the inkjet head while conveying the sheet constantly at the printing conveyance speed.

In this case, a portion of the sheet which is conveyed under the inkjet head during the acceleration to reach the printing conveyance speed from the start of conveyance is not used and is wasted. This portion which is wasted is referred to as wasted portion. This wasted portion becomes wasted paper when cut from the sheet.

Reducing tension applied to the sheet during the acceleration reduces load on a conveyer, and this can reduce acceleration time required for the sheet to reach the printing conveyance speed. The wasted portion can be thereby reduced.

SUMMARY

Meanwhile, when the tension applied to the sheet during the acceleration is reduced, the behavior of the sheet becomes unstable and the sheet may come into contact with the inkjet head.

An object of the disclosure is to provide an inkjet printer that can reduce a wasted portion which is not used in printing and is wasted, while suppressing contact of the sheet with the inkjet head.

An inkjet printer in accordance with some embodiments includes: a conveyer configured to convey a sheet of continuous paper; an inkjet head configured to perform printing by ejecting ink onto the sheet; a tension adjuster configured to adjust a tension of the sheet; a head gap adjuster configured to adjust a head gap being a gap between the inkjet head and the sheet; and a controller configured to control the conveyer, the inkjet head, the tension adjuster, and the head gap adjuster. The controller is configured to: drive the conveyer to start to convey the sheet and accelerate the sheet to a printing conveyance speed, and drive the inkjet head to start to perform the printing while driving the conveyer to convey the sheet at the printing conveyance speed; and drive the tension adjuster to adjust the tension of the sheet such that the tension of the sheet during acceleration after start of conveyance of the sheet is smaller than the tension of the sheet during the printing, and drive the head gap adjuster to adjust the head gap such that a first head gap during the acceleration of the sheet is greater than a second head gap during the printing.

In the configuration described above, it is possible to reduce load on the conveyer and reduce acceleration time by setting the tension during the acceleration after the start of conveyance of the sheet to a value smaller than the tension during the printing. A wasted portion which is not used in the printing and is wasted can be thereby reduced. Moreover, contact, of the sheet with the inkjet head can be suppressed by setting the first head gap during the acceleration of the sheet to a value greater than the second head gap during the printing. Accordingly, it is possible to reduce the wasted portion while suppressing the contact of the sheet with the inkjet head. In the case where the wasted portion is cut from the sheet, reduction of wasted sheet is achieved.

After the start of conveyance of the sheet and before start of the printing, the controller may be configured to drive the tension adjuster to increase the tension of the sheet from a tension at the start of conveyance of the sheet to the tension during the printing while driving the head gap adjuster to reduce the head gap from a third head gap at the start of conveyance of the sheet to the second head gap during the printing.

In the configuration described above, the tension of the sheet is increased from the tension at the start of conveyance to the tension during the printing while the head gap is reduced from the third head gap at the start of conveyance to the second head gap during the printing. The tension of the sheet and the head gap can be thereby set to those during the printing with the contact of the sheet with the inkjet head and an increase in the amount of wasted portion (wasted paper amount) being suppressed.

DETAILED DESCRIPTION

Figure 1:
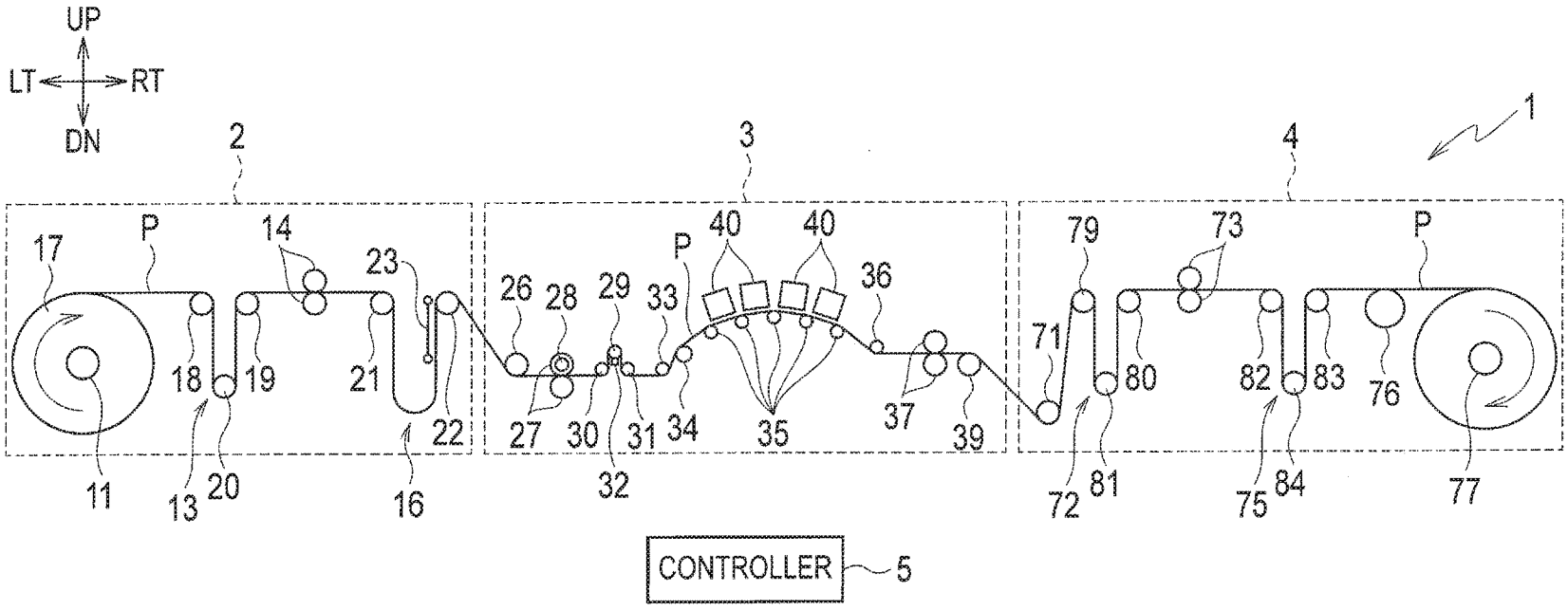
FIG. 1 is a schematic configuration diagram of an ink jet printer in an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
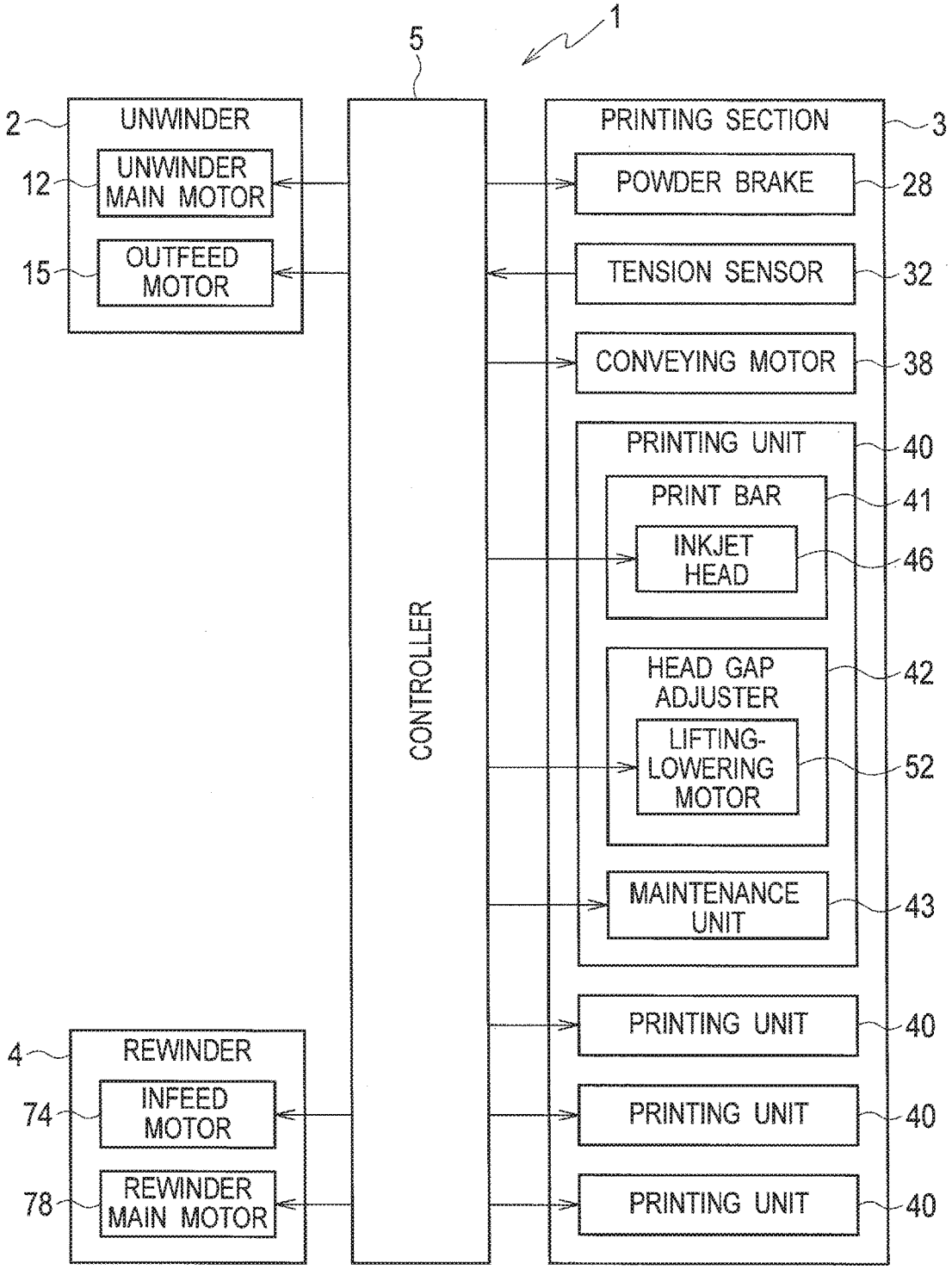
FIG. 2 is a control block diagram of the inkjet printer in the embodiment.
Figure 3:
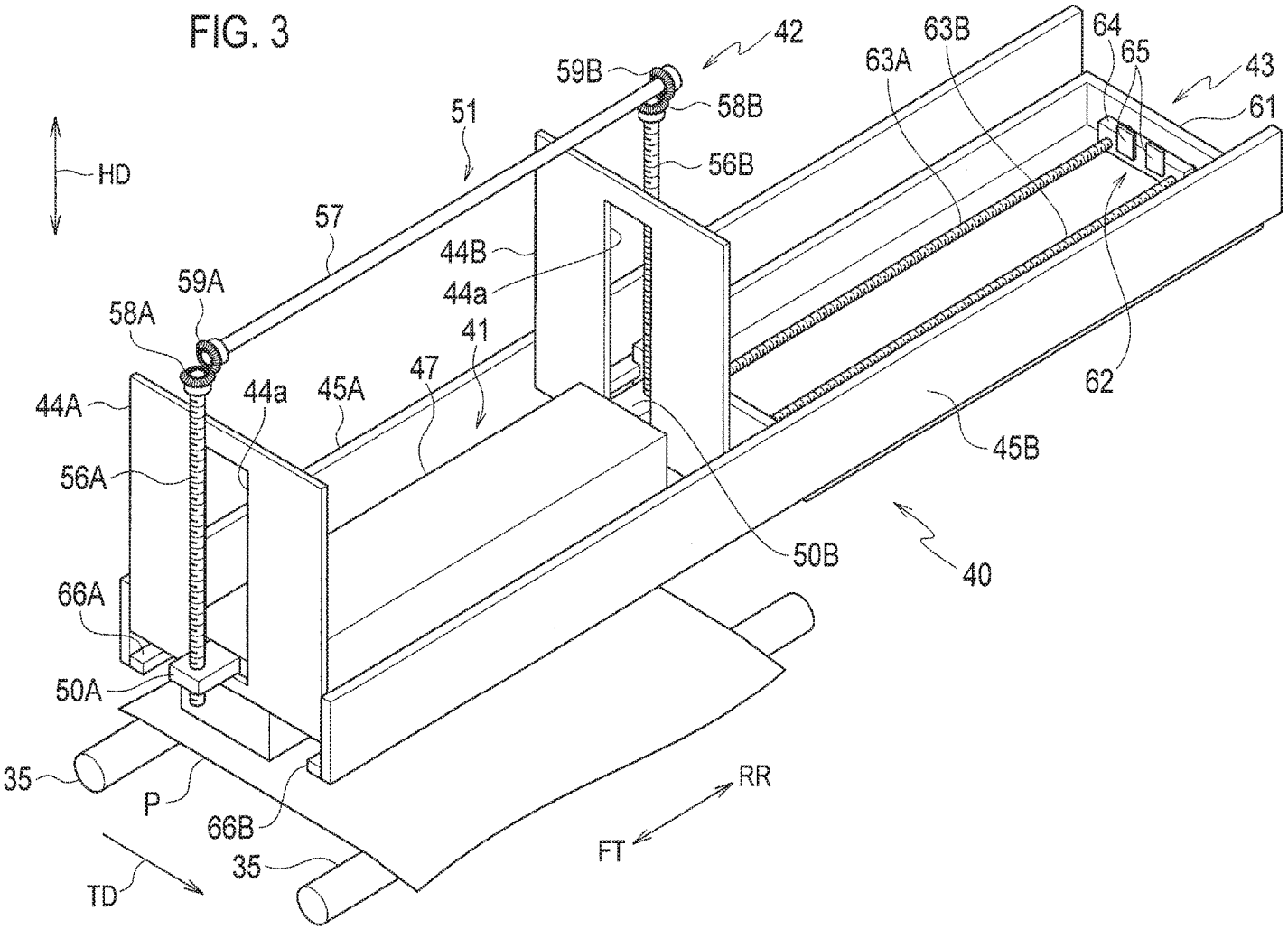
FIG. 3 is a perspective view illustrating a schematic configuration of a printing unit of the ink jet printer in the embodiment.
Figure 4:
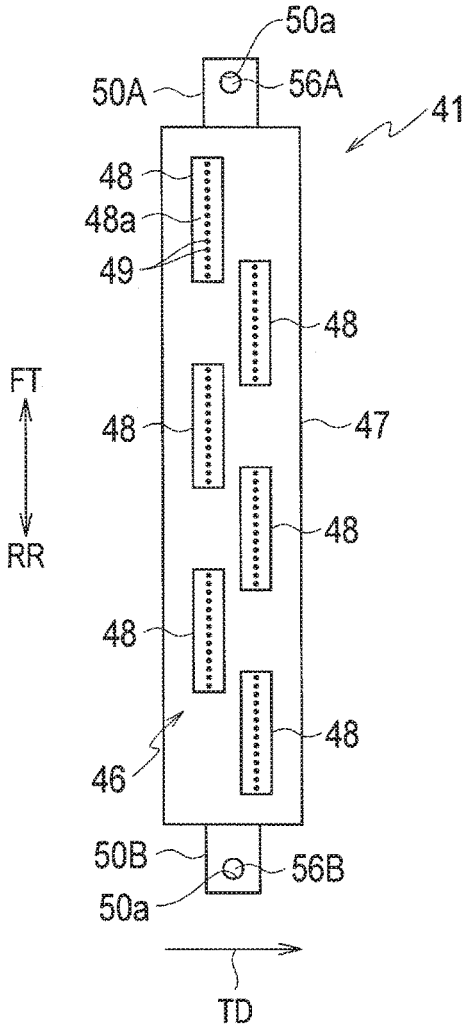
FIG. 4 is a bottom view of a print bar of the inkjet printer in the embodiment.
Figure 5:
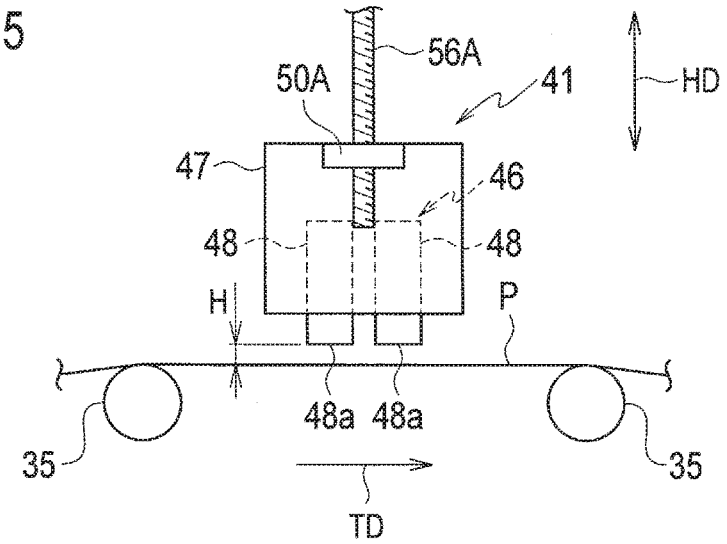
FIG. 5 is a front view of the print bar of the inkjet printer in the embodiment.

FIG. 1 is a schematic configuration diagram of an inkjet printer 1 in an embodiment of the present invention. FIG. 2 is a control block diagram of the inkjet printer 1 illustrated in FIG. 1. FIG. 3 is a perspective view illustrating a schematic configuration of a printing unit 40 of the inkjet printer 1 illustrated in FIG. 1. FIG. 4 is a bottom view of a print bar 41 of the inkjet printer 1 illustrated in FIG. 1. FIG. 5 is a front view of the print bar 41. In FIGS. 1, 3, 4, 5 and 7, directions of right, left, up, down, front, and rear, a conveying direction, and a head height direction are denoted by RT, LT, UP, DN, FT, RR, TD, and HD, respectively.

As illustrated in FIGS. 1 and 2, the inkjet printer 1 includes a unwinder 2, a printing section 3, a rewinder 4, and a controller 5.

The unwinder 2 unwinds a sheet P of long continuous paper and sends the sheet P to the printing section 3. As illustrated in FIGS. 1 and 2, the unwinder 2 includes a sheet roll supporting shaft 11, an unwinder main motor 12, a first buffer unit 13, a pair of outfeed rollers 14, an outfeed motor 15, and a second buffer unit 16.

The sheet roll supporting shaft 11 supports a sheet roll 17 such that the sheet roll 17 is rotatable. The sheet roll supporting shaft 11 is formed to have an elongated shape extending in a front-rear direction. The sheet roll 17 is rolled sheet P.

The unwinder main motor 12 rotates the sheet roll supporting shaft 11 clockwise in FIG. 1. Rotating the sheet roll supporting shaft 11 rotates the sheet roll 17 in the same direction, and the sheet P is unwound and sent downstream (rightward).

The first buffer unit 13 absorbs a difference in speed of the sheet P between the sheet roll supporting shaft 11 and the pair of outfeed rollers 14. The first buffer unit 13 includes supporting rollers 18, 19 and a dancer roller 20.

The supporting rollers 18, 19 support the sheet P between the sheet roll 17 and the pair of outfeed rollers 14. The supporting rollers 18, 19 are arranged at the same height, away from each other in a left-right direction by a predetermined interval.

The dancer roller 20 pushes down the sheet P between the supporting rollers 18, 19 by using its own weight. The first buffer unit 13 thereby absorbs a slack in the sheet P corresponding to the difference in speed of the sheet P between the sheet roll supporting shaft 11 and the pair of outfeed rollers 14. The dancer roller 20 moves up and down depending on the amount of slack in the sheet P.

The pair of outfeed rollers 14 conveys the sheet P unwound from the sheet roll 17, to the printing section 3. The pair of outfeed rollers 14 is arranged between the first buffer unit 13 and the second buffer unit 16, and conveys the sheet P while nipping the sheet P.

The outfeed motor 15 rotationally drives the outfeed rollers 14.

The second buffer unit 16 absorbs a difference in speed of the sheet P between the pair of the outfeed rollers 14 and a pair of tension applying rollers 27 of the printing section 3 to be described later. The second buffer unit 16 has supporting rollers 21, 22 and a sheet warping suppressor 23.

The supporting rollers 21, 22 support the sheet P between the pair of outfeed rollers 14 and a guide roller 26 of the printing section 3 to be described later while maintaining a slack in the sheet P between the supporting rollers 21, 22. The supporting rollers 21, 22 are arranged at the same height, away from each other in the left-right direction by a predetermined interval.

The sheet warping suppressor 23 suppresses warping of the sheet P due to changes in behavior thereof between the supporting rollers 21, 22.

The printing section 3 performs printing on the sheet P conveyed from the unwinder 2 while conveying the sheet P. The printing section 3 includes the guide roller 26, the pair of tension applying rollers 27, a powder brake (tension adjuster) 28, a tension detecting roller 29, tension detection assisting rollers 30, 31, a tension sensor 32, guide rollers 33, 34, five under-head supporting rollers 35, a guide roller 36, a pair of conveying rollers 37, a conveying motor 38, a guide roller 39, and four printing units 40. Note that the conveying rollers 37 and the conveying motor 38 form a conveyer.

The guide roller 26 guides the sheet P between the supporting roller 22 of the unwinder 2 and the pair of tension applying rollers 27.

The pair of tension applying rollers 27 applies tension to the sheet P. The pair of tension applying rollers 27 rotates to follow the sheet P conveyed by the pair of conveying rollers 37, while nipping the sheet P. Meanwhile, the pair of tension applying rollers 27 is braked by using the powder brake 28, and tension is thereby applied to the sheet P between the pair of conveying rollers 37 and the pair of tension applying rollers 27.

The powder brake 28 brakes one of the tension applying rollers 27. The tension of the sheet P is adjusted in correspondence with output of the powder brake 28.

The tension detecting roller 29 is a roller around which the sheet P is wound to detect the tension of the sheet P. The sheet P is wound around the tension detecting roller 29 from above.

The tension detection assisting rollers 30, 31 assist wounding of the sheet P around the tension detecting roller 29. The tension detection assisting rollers 30, 31 are arranged below the tension detecting roller 29, away from each other in the left-right direction with the tension detecting roller 29 provided therebetween. The tension detection assisting rollers 30, 31 press the sheet P from above, upstream (on the left side) and downstream (on the right side) of the tension detecting roller 29, respectively.

The tension sensor 32 detects the tension of the sheet P by receiving and detecting load corresponding to the tension of the sheet P from the tension detecting roller 29.

The guide rollers 33, 34 guide the sheet P between the tension detection assisting roller 31 and the set of the under-head supporting rollers 35.

The under-head supporting rollers 35 support the sheet P below the printing units 40. The five under-head supporting rollers 35 are arranged in an arch protruding upward between the guide roller 34 and the guide roller 36. The sheet P is thereby set in a tensioned state between each adjacent pair of under-head supporting rollers 35 and the sheet P is maintained in a stable position.

The guide roller 36 guides the sheet P between the set of under-head supporting rollers 35 and the pair of conveying rollers 37.

The pair of conveying rollers 37 conveys the sheet P to the rewinder 4. The pair of conveying rollers 37 is arranged downstream (on the right side) of the guide roller 36 and conveys the sheet P while nipping the sheet P.

The conveying motor 38 rotationally drives the conveying rollers 37.

The guide roller 39 guides the sheet P between the pair of conveying rollers 37 and a guide roller 71 of the rewinder 4 to be described later.

The printing units 40 perform printing on the conveyed sheet P. The four printing units 40 perform printing by using inks different in color. Each of the four printing units 40 is arranged between two of the under-head supporting rollers 35 adjacent to each other. The four printing units 40 have the same configuration except for the point that the colors of inks are different from one another.

As illustrated in FIGS. 2 and 3, each of the printing units 40 includes the print bar 41, a head gap adjuster 42, a maintenance unit 43, and print bar frames 44A, 44B, 45A, 45B. Note that the head height direction in FIG. 3 is a direction orthogonal to the sheet P between the adjacent two under-head supporting rollers 35. The conveying direction in FIG. 3 is a direction orthogonal to the head height direction and the front-rear direction.

As illustrated, in FIGS. 4 and 5, the print bar 41 includes an inkjet head 46 and a head holder 47.

The inkjet head 46 ejects the ink onto the sheet P. The inkjet head 46 has six head modules 48.

Each of the head modules 48 has multiple nozzles 49 open on an ink ejection surface 48*a* and ejects the ink from the nozzles 49. The ink ejection surface 48*a* is a surface of the head module 48 facing the sheet P, and is a lower surface of the head module 48. The nozzles 49 are arranged in a main scanning direction (front-rear direction) orthogonal to the conveying direction of the sheet P.

In the inkjet head 46, the head modules 48 are arranged in zigzag. Specifically, the head modules 48 are formed such that two head rows each including three head modules 48 arranged at equal intervals in the front-rear direction are arranged while being offset from each other in the front-rear direction by half a pitch.

The head holder 47 holds the inkjet head 46. The head holder 47 is formed in a hollow cuboid shape elongating in the front-rear direction. As illustrated in FIG. 5, the head holder 47 holds the head modules 48 such that lower end portions of the head modules 48 protrude from a bottom surface of the head holder 47. Sliders 50A, 50B are formed respectively in a front surface portion and a rear surface portion of the head holder 47.

The sliders 50A, 50B are portions through which guide screws 56A, 56B to be described later penetrate. Female screw holes 50*a* penetrating through the sliders 50A, 50B in the head height direction are formed in the sliders 50A, 50B.

The head gap adjuster 42 adjusts a head gap H. As illustrated in FIG. 5, the head gap H is a gap between the ink ejection surface 48*a* of each head module 48 and the sheet P. The head gap adjuster 42 includes a lifting-lowering mechanism 51 and a lifting-lowering motor 52.

The lifting-lowering mechanism 51 lifts and lowers the print bar 41 in the head height direction by being driven by drive force of the lifting-lowering motor 52. The lifting-lowering mechanism 51 includes the guide screws 56A, 56B and a synchronization shaft 57.

The guide screws 56A, 56B lift and lower the print, bar 41 by being rotated. The guide screws 56A, 56B are installed such that the axial directions thereof are aligned in the head height direction. The guide screws 56A, 56B penetrate through the female screw holes 50*a* of the sliders 50A, 50B of the head holder 47 and are screwed, thereto, respectively. Accordingly, when the guide screws 56A, 56B are rotated, the sliders 50A, 50B are moved along the guide screws 56A, 56B, and the print bar 41 are thereby lifted and lowered. Bevel gears 58A, 58B are fixed respectively to upper end portions of the guide screws 56A, 56B. The bevel gears 58A, 58B mesh respectively with bevel gears 59A, 59B to be described later which are fixed to the synchronization shaft 57.

The synchronization shaft 57 is a shaft for rotating the guide screws 56A, 56B in synchronization. The synchronization shaft 57 is installed such that the axial direction thereof is aligned with the front-rear direction. The synchronization shaft 57 rotates about its axis by being driven by the lifting-lowering motor 52. The bevel gears 59A, 59B are fixed respectively to a front end portion and a rear end portion of the synchronization shaft 57. The bevel gears 59A, 59B mesh respectively with the bevel gears 58A, 58B of the guide screws 56A, 56B. The rotation of the synchronization shaft 57 is thereby transmitted to the guide screws 56A, 56B.

The lifting-lowering motor 52 rotates the synchronization shaft 57. The lifting-lowering motor 52 is formed of a stepping motor.

The maintenance unit 43 performs maintenance of the inkjet head 46. The maintenance unit 43 is movable in the front-rear direction between a standby position and a maintenance position by being driven by drive force of a not-illustrated motor.

The standby position is a position where the maintenance unit 43 waits during other than the maintenance of the inkjet head 46, and is the position of the maintenance unit 43 illustrated in FIG. 3. The standby position is behind the maintenance position. The maintenance position is a position of the maintenance unit 43 during the maintenance of the inkjet head 46, and is a position directly below the inkjet head 46. When the maintenance unit 43 is arranged at the maintenance position, the print bar 41 is retreated upward by the lifting-lowering mechanism 51.

The maintenance unit 43 includes an ink receiving portion 61 and a wiper unit 62.

The ink receiving portion 61 receives the ink and the like removed and falling from the ink ejection surfaces 48*a* of the head modules 48 during the maintenance of the inkjet head 46. The ink receiving portion 61 has a rectangular tray shape in a plan view. Guide screws 63A, 63B are arranged in the ink receiving portion 61. The guide screws 63A, 63B are installed such that the axial directions thereof are aligned with the front-rear direction. The guide screws 63A, 63B receive the drive force of the not-illustrated motor and are rotated to move the wiper unit 62 in the front-rear direction.

The wiper unit 62 wipes the ink ejection surfaces 48*a* of the head modules 48 and removes the ink and the like on the ink ejection surfaces 48*a*. The wiper unit 62 includes a wiper supporter 64 and two wipers 65.

The wiper supporter 64 is a member to which the wipers 65 are attached. Two female screw holes penetrating through the wiper supporter 64 in the front-rear direction are formed in the wiper supporter 64. The guide screws 63A, 63B are screwed to these female screw holes.

The wipers 65 are members for wiping the ink ejection surfaces 48*a* of the head modules 48. The wipers 65 are made of material such as rubber which is elastically deformable and are formed in a plate shape. The two wipers 65 each wipe the ink ejection surfaces 48*a* of the head modules 48 in one of the two head rows extending in the front-rear direction in the inkjet head 46.

The print bar frames 44A, 44B, 45A, 45B are frames surrounding the print bar 41.

The print bar frames 44A, 44B are arranged respectively in front of and behind the print bar 41. An opening 44*a* elongating in the head height direction is formed in each of the print bar frames 44A, 44B. The sliders 50A, 50B are inserted respectively into the opening 44*a* of the print bar frame 44A and the opening 44*a* of the print bar frame 44B.

The print bar frames 45A, 45B are arranged upstream and downstream of the print bar 41, respectively. The print bar frames 45A, 45B are formed in a shape elongating in the front-rear direction. Guide rails 66A, 66B are provided respectively on the print, bar frames 45A, 45B. The maintenance unit 43 is moved along the guide rails 66A, 66B.

The rewinder 4 winds the sheet P subjected to printing in the printing section 3. The rewinder 4 includes the guide roller 71, a third buffer unit 72, a pair of infeed rollers 73, an infeed motor 74, a fourth buffer unit 75, a guide roller 76, a winding shaft 77, and a rewinder main motor 78.

The guide roller 71 guides the sheet P between the guide roller 39 of the printing section 3 and a supporting roller 79 to be described later.

The third buffer unit 72 absorbs a difference in speed of the sheet P between the pair of conveying rollers 37 of the printing section 3 and the pair of infeed rollers 73. The third buffer unit 72 includes supporting rollers 79, 80 and a dancer roller 81.

The supporting rollers 79, 80 support the sheet P between the guide roller 71 and the pair of infeed rollers 73. The supporting rollers 79, 80 are arranged at the same height, away from each other in the left-right direction by a predetermined interval.

The dancer roller 81 pushes down the sheet P between the supporting rollers 79, 80 by using its own weight. The third buffer unit 72 thereby absorbs a slack in the sheet P corresponding to the difference in speed of the sheet P between the pair of the conveying rollers 37 of the printing section 3 and the pair of infeed rollers 73. The dancer roller 81 moves up and down depending on the amount of slack in the sheet P.

The pair of infeed rollers 73 conveys the sheet P sent out from the printing section 3, to the winding shaft 77. The pair of infeed rollers 73 is arranged between the third buffer unit 72 and the fourth buffer unit 75 and conveys the sheet P while nipping the sheet P.

The infeed motor 74 rotationally drives the infeed rollers 73.

The fourth buffer unit 75 absorbs a difference in speed of the sheet P between the pair of infeed rollers 73 and the winding shaft 77. The fourth buffer unit 75 includes supporting rollers 82, 83 and a dancer roller 84.

The supporting rollers 82, 83 support the sheet P between the pair of infeed rollers 73 and the guide roller 76. The supporting rollers 82, 83 are arranged at the same height, away from each other in the left-right direction by a predetermined interval.

The dancer roller 84 pushes down the sheet P between the supporting rollers 82, 83 by using its own weight. The fourth buffer unit 75 thereby absorbs a slack in the sheet P corresponding to the difference in speed of the sheet P between the pair of infeed rollers 73 and the winding shaft 77. The dancer roller 84 moves up and down depending on the amount of slack in the sheet P.

The guide roller 76 guides the sheet P between the supporting roller 83 and the winding shaft 77.

The winding shaft 77 is a shaft around which the sheet P is wound, and holds the sheet P. The winding shaft 77 is formed in an elongated shape extending in the front-rear direction.

The rewinder main motor 78 rotates the winding shaft 77 clockwise in FIG. 1. The sheet P is wound around the winding shaft 77 by the rotation of the winding shaft 77.

The controller 5 controls operations of units in the inkjet printer 1. The controller 5 includes a CPU, a RAM, a ROM, a hard disk drive, and the like.

In the case of performing printing, the controller 5 performs control of causing the conveying rollers 37 and the conveying motor 38 in the printing section 3 to start conveyance of the sheet P, and after the conveyance speed reaches a printing conveyance speed Vg, causing the inkjet heads 46 to perform printing while conveying the sheet P at the printing conveyance speed Vg. In the case of starting the conveyance of the sheet P, the controller 5 controls the powder brake 28 such that the tension during acceleration after the start of conveyance of the sheet P is smaller than the tension during the printing and controls the lifting-lowering motor 52 such that the head gap H during the acceleration of the sheet P is greater than the head gap H during the printing.

Next, operations of the inkjet printer 1 are described.

Figure 6:
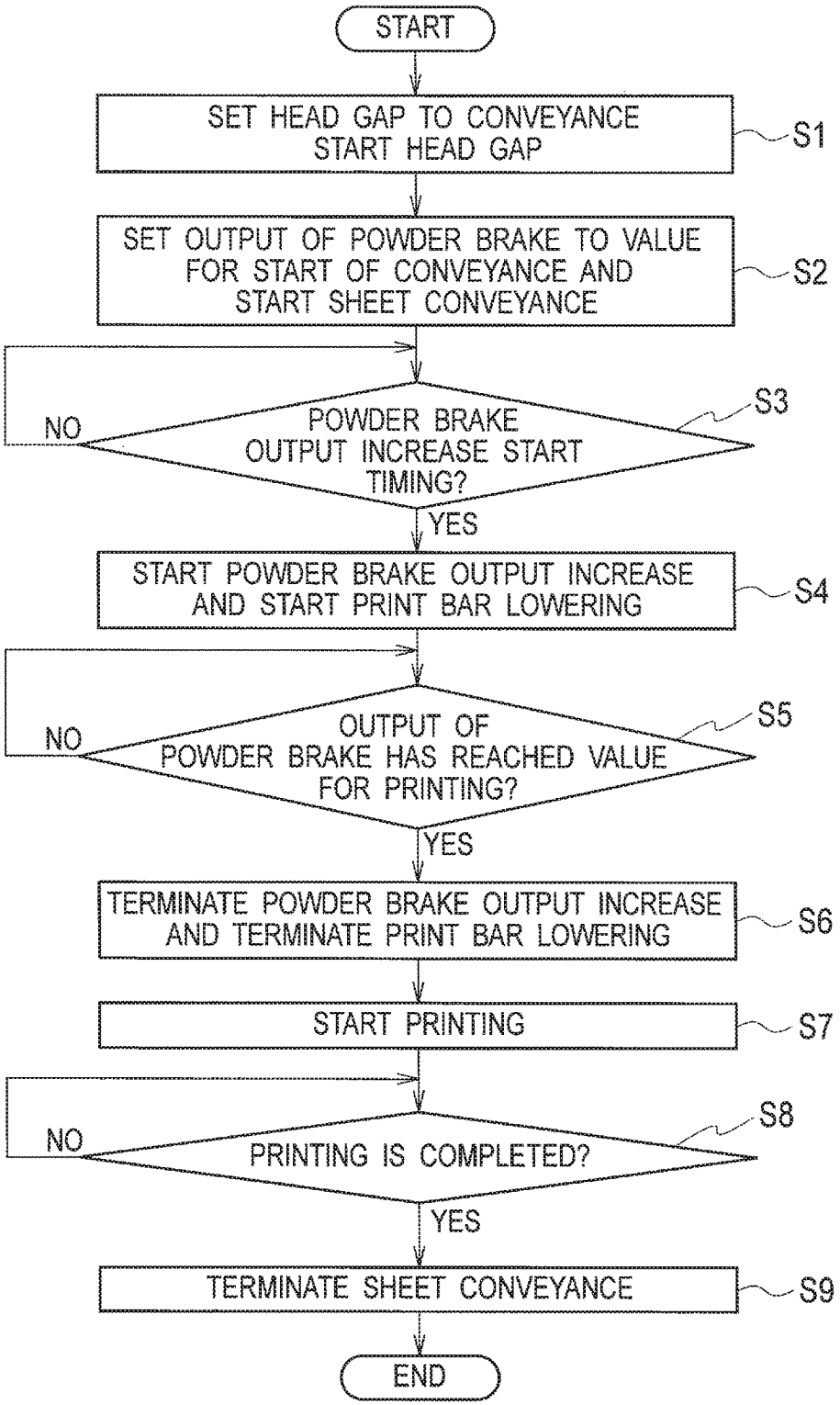
FIG. 6 is a flowchart for explaining operations of the inkjet printer in the embodiment.

FIG. 6 is a flowchart for explaining operations of the inkjet printer 1. Processing of the flowchart of FIG. 6 starts when the inkjet printer 1 receives a print job.

In step S1 of FIG. 6, the controller 5 sets the head gap H to a conveyance start head gap Hs. The conveyance start head gap Hs is a value set as the head gap H at the start of the conveyance of the sheet P. The conveyance start head gap Hs is a value greater than a printing head gap Hp. The printing head gap Hp is a value set as the head gap H during the printing performed by ejecting the inks from the inkjet heads 46.

Figure 7:
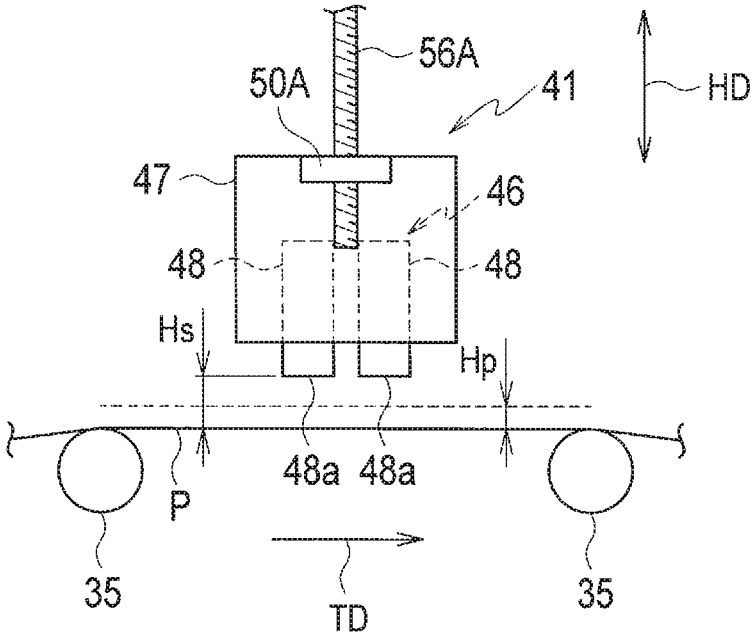
FIG. 7 is a view illustrating a state where a head gap is set to a conveyance start head gap.

In a standby state before the start of sheet conveyance, the head gap H is set to the printing head gap Hp. In order to set the head gap H to the conveyance start head gap Hs, the controller 5 controls the lifting-lowering motor 52 to start lifting the print bar 41. Thereafter, when the controller 5 determines that the head gap H has reached the conveyance start head gap Hs, based on the number of drive pulses of the lifting-lowering motor 52, the controller 5 stops the lifting-lowering motor 52. The head gap H is thereby set to the conveyance start head gap Hs as illustrated in FIG. 7.

Next, in step S2, the controller 5 sets the output of the powder brake 28 to a value for the start of conveyance.

The output of the powder brake 28 at the start of conveyance is a value smaller than the output of the powder brake 28 during the printing. For example, the output of the powder-brake 28 at the start of conveyance is "0" (no brake is applied). Then, the controller 5 starts the sheet conveyance. Specifically, the controller 5 starts the drive of the unwinder main motor 12, the outfeed motor 15, the conveying motor 38, the infeed motor 74, and the rewinder main motor 78. In the printing section 3, the sheet P between the pair of conveying rollers 37 and the pair of tension applying rollers 27 is thereby conveyed with the tension corresponding to the output of the powder brake 28 applied to the sheet P.

Next, in step S3, the controller 5 determines whether it is a powder brake output increase start timing. The powder brake output increase start timing is set as follows. Specifically, the powder brake output increase start timing is set such that, when the increase of the output of the powder brake 28 is started at the powder brake output increase start timing, the speed of conveyance by the conveying rollers 37 reaches the printing conveyance speed Vg at a timing at which the output of the powder brake 28 reaches the value for the printing.

When the controller 5 determines that it is not the powder brake output increase start timing (step S3: NO), the controller 5 repeats step S3.

When the controller 5 determines that it is the powder brake output increase start timing (step S3: YES), in step S4, the controller 5 starts increasing the output of the powder brake 28. The tension of the sheet P between the pair of tension applying rollers 27 and the pair of conveying rollers 37 thereby begins to increase. At the same time, the controller 5 controls the lifting-lowering motor 52 to start lowering the print bar 41. The controller 5 controls the lifting-lowering motor 52 to lower the print bar 41 such that the head gap H reaches the printing head gap Hp at a timing at which the conveyance speed of the sheet P reaches the printing conveyance speed Vg (at the timing at which the output of the powder brake 28 reaches the value for the printing).

Then, in step S5, the controller 5 determines whether the output of the powder brake 28 has reached the value for the printing. When the controller 5 determines that the output of the powder brake 28 has not reached the value for the printing (step S5: NO), the controller 5 repeats step S5.

When the controller 5 determines that the output of the powder brake 28 has reached the value for the printing (step S5: YES), in step S6, the controller 5 terminates the increase of the output of the powder brake 28. Moreover, the controller 5 stops the lifting-lowering motor 52 and terminates the lowering of the print bar 41.

Since the powder brake output increase start timing is set as described above, the head gap H reaches the printing head gap Hp at the time point where the lowering of the print bar 41 is terminated simultaneously with the increase of the output of the powder brake 28. Moreover, the speed of conveyance by the conveying rollers 37 reaches the printing conveyance speed Vg. Hereafter, the controller 5 controls the conveying motor 38 such that the printing conveyance speed Vg is maintained. Furthermore, the controller 5 controls the powder brake 28 based on the detection value of the tension sensor 32 such that the tension of the sheet P is constant.

Next, in step S7, the controller 5 controls the inkjet heads 46 based on the print job and causes the inkjet heads 46 to start the printing.

Next, in step S8, the controller 5 determines whether the printing based on the print job is completed. When the controller 5 determines that the printing is not completed (step S8: NO), the controller 5 repeats step S8.

When the controller 5 determines that the printing is completed (step S8: YES), in step S9, the controller 5 terminates the sheet conveyance. Specifically, the controller 5 stops the unwinder main motor 12, the outfeed motor 15, the powder brake 28, the conveying motor 38, the infeed motor 74, and the rewinder main motor 78. A series of operations is thereby completed.

Figure 8:
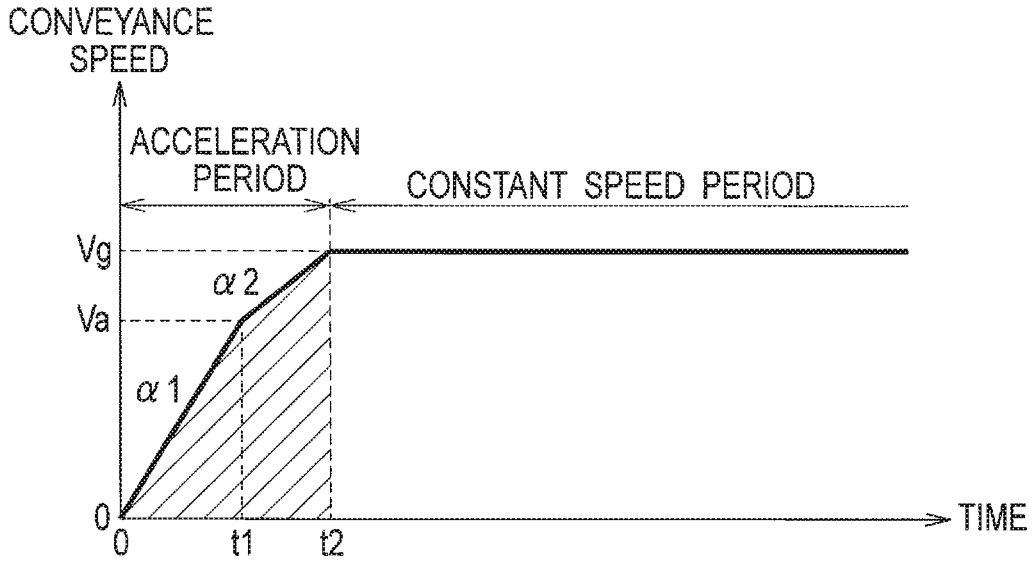
FIG. 8 is a graph depicting change in speed of conveyance by conveyance rollers from start of sheet conveyance in the inkjet printer in the embodiment.
Figure 9:
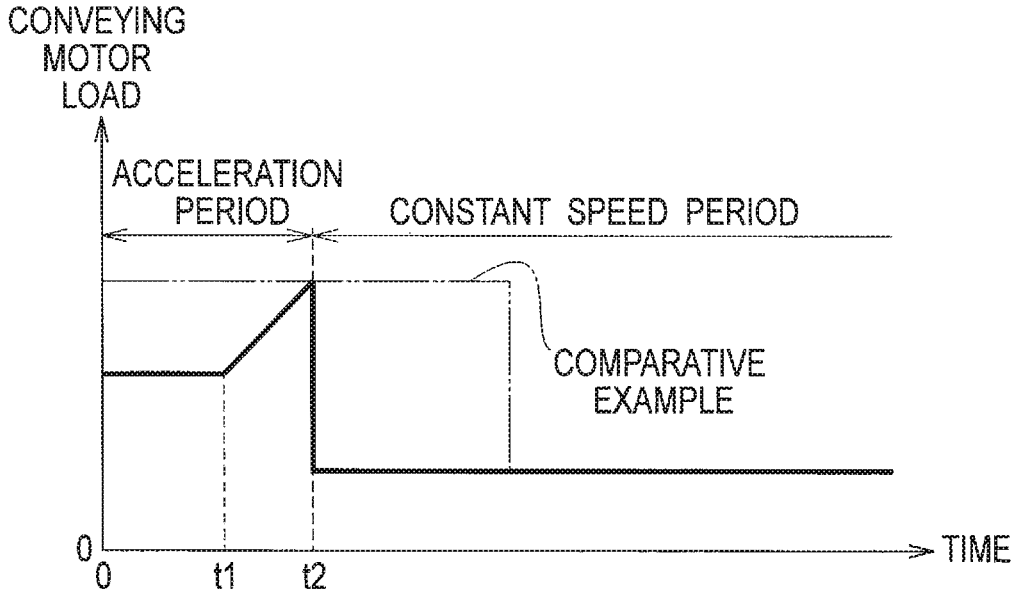
FIG. 9 is a graph depicting change in load on a conveying motor from the start of sheet conveyance in the inkjet printer in the embodiment.
Figure 10:
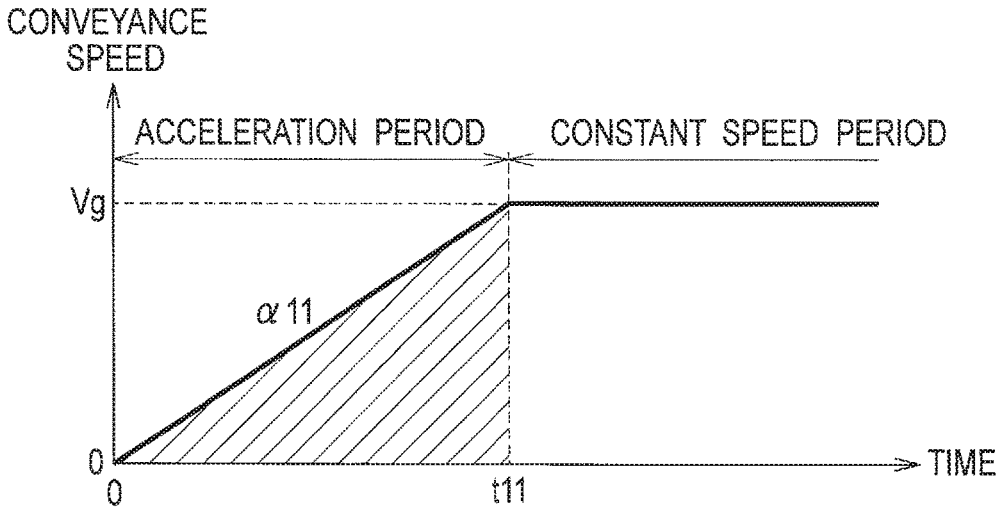
FIG. 10 is a graph depicting change in the speed of conveyance by the conveyance rollers from the start of sheet conveyance in a comparative example.
Figure 11:
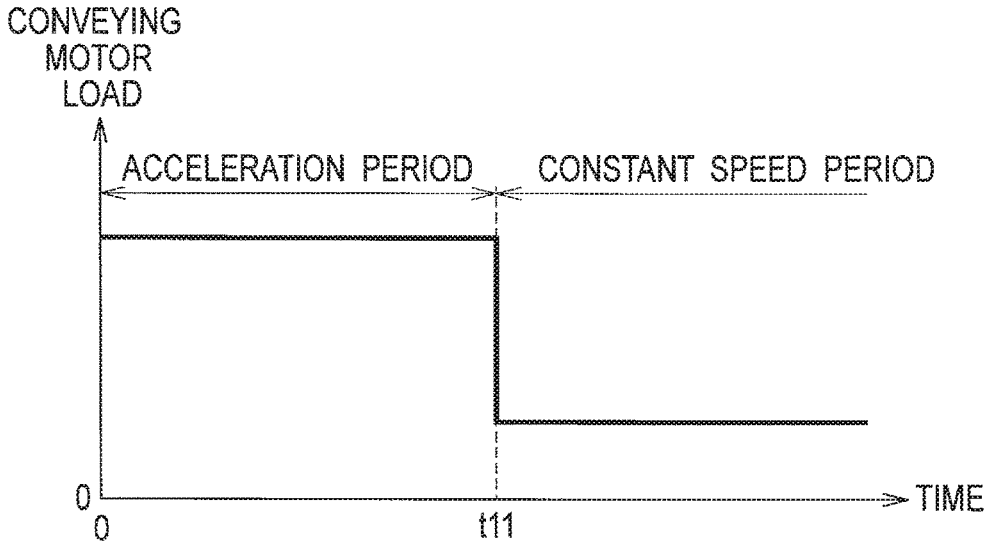
FIG. 11 is a graph depicting change in the load on the conveying motor from the start of sheet conveyance in the comparative example.

FIG. 8 depicts a change in speed of conveyance by the conveying rollers 37 from the start of sheet conveyance by the inkjet printer 1 performing the operations described above. Meanwhile, FIG. 9 depicts a change in load of the conveying motor 38 from the start of sheet conveyance. As a comparative example to these changes, FIG. 10 depicts a change in speed of conveyance by the conveying rollers 37 when the output of the powder brake 28 is set to the value for the printing from the start of sheet conveyance. Meanwhile, FIG. 11 depicts a change in load of the conveying motor 38 from, the start of sheet conveyance in this case.

In the comparative example, as depicted in FIG. 10, after the start of sheet conveyance, the sheet P is accelerated at acceleration α11 in an acceleration period up to a time 11 at which the conveyance speed, reaches the printing conveyance speed Vg. A period after the time t11 is a constant speed period in which the conveyance speed is constantly set to the printing conveyance speed Vg. As depicted in FIG. 11, load on the conveying motor 38 in the acceleration period is greater than that in the constant speed period.

In the embodiment, as depicted in FIG. 9, the load on the conveying motor 38 is a constant value smaller than that in the comparative example, up to a time t1 which is the powder brake output increase start, timing. This is because the output of the powder brake 28 is set to the value for the start of conveyance which is smaller than the value for the printing. Although the load on the conveying motor 38 increases with the increase of the output of the powder brake 28 from the time t1 to a time t2 at which the conveyance speed reaches the printing conveyance speed Vg, the load in the embodiment is smaller than the load in the comparative example.

Thus, as illustrated in FIG. 8, from the start of sheet conveyance to the time t1, the sheet P is accelerated at acceleration, α1 which is greater than the acceleration α11 in the comparative example. From the time t1 to the time t2, the sheet P is accelerated at acceleration α2 which is smaller than α1 and greater than α11. Specifically, the acceleration of the sheet P in the entire acceleration period from the start of sheet conveyance to the time t2 is greater than the acceleration in the acceleration period in the comparative example. Hence, in the embodiment, the acceleration period is shorter than that in the comparative example, and a wasted portion (wasted paper) which is not used for the printing and is wasted is reduced.

Specifically, an amount of wasted portion (wasted paper amount) L1 in the embodiment corresponds to the area of a hatched region in FIG. 8, and is expressed by the following formula (1).

$$L1=Va^2/(2\times\alpha1)+(Vg^2-Va^2)/(2\times\alpha2) \quad (1)$$

where Va is the conveyance speed of the sheet P at the powder brake output increase start timing (time t1).

An amount of wasted portion (wasted paper amount) L2 in the comparative example corresponds to the area of a hatched region in FIG. 10, and is expressed by the following formula (2).

$$L2=Vg^2/(2\times\alpha11) \quad (2).$$

The following formula (3) is obtained from the formulae (1) and (2).

$$L2-L1=Vg^2\times(1/\alpha11-1/\alpha2)/2+Va^2\times(1/\alpha2-1/\alpha1)/2 \quad (3).$$

Since $\alpha 11<\alpha 2$ and $\alpha 2<\alpha 1$, we see from the formula (3) that $L1<L2$.

As described above, in the inkjet printer 1, the controller 5 controls the powder brake 28 such that the tension during the acceleration after the start of conveyance of the sheet P is smaller than the tension during the printing. Specifically, the controller 5 sets the output of the powder brake 28 during the acceleration after the start of conveyance of the sheet P to a value smaller than the value for the printing. This can reduce the load on the conveying motor 38 during the acceleration and reduce the acceleration time. As a result, the wasted portion (wasted paper) can be reduced.

Moreover, the controller 5 controls the lifting-lowering motor 52 such that the head, gap H during the acceleration of the sheet P is greater than the printing head gap Hp. Contact of the sheet P with the inkjet heads 46 can be thereby suppressed.

Accordingly, the inkjet printer 1 can reduce the wasted portion (wasted paper) while suppressing the contact of the sheet P with the inkjet heads 46.

Moreover, in the inkjet printer 1, the controller 5 controls the powder brake 28 such that the tension of the sheet P is increased from the tension at the start of conveyance to the tension during the printing and, at the same time, controls the lifting-lowering motor 52 such that the head gap H is reduced from the conveyance start head gap Hs to the printing head gap Hp. Increasing the tension of the sheet P and reducing the head gap H in parallel as described above can suppress an increase in time required to set the tension of the sheet P and the head gap H respectively to the tension during the printing and the printing head gap Hp. Accordingly, an increase in the amount of wasted portion (wasted paper amount) can be suppressed. Moreover, since the tension of the sheet P is increased with the reduction of the head gap H, it is possible to suppress the contact of the sheet P with the inkjet heads 46 while setting the tension of the sheet P and the head gap H to the tension of the sheet P during the printing and the printing head gap Hp.

Hence, it is possible set the tension of the sheet P and the head gap H to the tension of the sheet P during the printing and the printing head gap Hp while suppressing the contact of the sheet P with the inkjet heads 46 and reducing the amount of wasted portion (wasted paper amount).

Note that, although the lowering of the print bar 41 (reduction of the head gap) is started at the powder brake output increase start timing in the embodiment described above, the lowering of the print bar 41 may start after the powder brake output increase start timing. Moreover, the timing at which the head gap H reaches the printing head gap Hp may be after the timing at which the conveyance speed of the sheet P reaches the printing conveyance speed Vg (timing at which the output of the powder brake 28 reaches the value for the printing).

Moreover, it is possible to perform control such that the increase of the output of the powder brake 28 and the lowering of the print bar 41 are started after the speed of conveyance by the conveying rollers 37 reaches the printing conveyance speed Vg. Also in this case, the wasted portion (wasted paper) can be reduced by reducing the acceleration time by reducing the load on the conveying motor 38 during the acceleration of the sheet P. Moreover, since the head gap H is set to the conveyance start head gap Hs in a period up to the start of lowering of the print bar 41 which includes the period of acceleration of the sheet P, the contact of the sheet P with the inkjet heads 46 is suppressed.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

a conveyer configured to convey a sheet of continuous paper;

an inkjet head configured to perform printing by ejecting ink onto the sheet;

a tension adjuster configured to adjust a tension of the sheet;

a head gap adjuster configured to adjust a head gap being a gap between the inkjet head and the sheet; and a controller configured to control the conveyer, the inkjet head, the tension adjuster, and the head gap adjuster, wherein the controller is configured to:

drive the conveyer to start to convey the sheet and accelerate the sheet to a printing conveyance speed;

drive the inkjet head to start to perform the printing while driving the conveyer to convey the sheet at the printing conveyance speed;

drive the tension adjuster to adjust the tension of the sheet such that the tension of the sheet during acceleration after start of conveyance of the sheet is smaller than the tension of the sheet during the printing while driving the head gap adjuster to adjust the head gap such that a first head gap during the acceleration of the sheet is greater than a second head gap during the printing.

2. The inkjet printer according to claim 1, wherein after the start of conveyance of the sheet and before start of the printing, the controller is configured to drive the tension adjuster to increase the tension of the sheet from a tension at the start of conveyance of the sheet to the tension during the printing while driving the head gap adjuster to reduce the head gap from, a third head gap at the start of conveyance of the sheet to the second head gap during the printing.

3. The inkjet printer according to claim 2, wherein the controller is configured to:

determine whether the head gap has reached the third head gap at the start of conveyance based on a number of drive pulses of the head gap adjuster.

4. The inkjet printer according to claim 1, wherein the controller is configured to:

set an output for the tension adjuster at the start of conveyance of the sheet; and determine whether the output for the tension adjuster during acceleration after the start of conveyance of the sheet has reached a printing output value, wherein the controller increases the output of the tension adjuster while reducing the head gap between the inkjet head and the sheet until the printing output value has been reached, and when the output for the tension adjuster reaches the printing output value, the controller terminates the increase in the output for the tension adjuster.

5. The inkjet printer according to claim 4, wherein when the conveyance speed reaches the printing conveyance speed and the output of the tension adjuster reaches the printing output value, the reduction in head gap and the increase in the output for the tension adjuster are simultaneously terminated.

6. The inkjet printer according to claim 1, wherein the head gap adjuster includes:

a lifting-lowering mechanism including a least one rotatable guide; and a lifting-lowering motor to control rotation of the at least one rotatable guide, wherein when the at least one rotatable guide is rotated, the inkjet head is one of lifted or lowered in a direction perpendicular to a conveying direction of the sheet.

* * * * *